US008671724B2

(12) United States Patent
Uyeda

(10) Patent No.: US 8,671,724 B2
(45) Date of Patent: Mar. 18, 2014

(54) MULTIPLE ACCESS DOOR LOCK MECHANISM

(75) Inventor: Alan K. Uyeda, Irvine, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 387 days.

(21) Appl. No.: 12/799,018

(22) Filed: Apr. 19, 2010

(65) Prior Publication Data

US 2011/0252709 A1 Oct. 20, 2011

(51) Int. Cl.

| | |
|---|---|
| ***E05B 47/00*** | (2006.01) |
| ***E05B 47/06*** | (2006.01) |
| ***E05C 7/00*** | (2006.01) |
| ***E05C 1/00*** | (2006.01) |

(52) U.S. Cl.

USPC ..... 70/279.1; 70/107; 70/108; 70/109; 70/110; 70/111; 70/277; 70/280; 70/281; 70/282; 70/283; 292/3; 292/32

(58) Field of Classification Search

USPC ..... 70/107–11, 277, 278.7, 279.1, 70/280–283, 283.1; 292/1, 137, 138, 163, 292/169, 169.13, 140, 144, 347, 3, 7, 32, 292/37, 124

See application file for complete search history.

(56) References Cited

U.S. PATENT DOCUMENTS

| | | | | |
|---|---|---|---|---|
| 2,696,728 | A | 12/1954 | Jewett et al. | |
| 2,936,606 | A | 5/1960 | Welch et al. | |
| 3,026,703 | A | 3/1962 | Welch | |
| 4,021,065 | A | 5/1977 | Geringer | |
| 4,073,518 | A * | 2/1978 | Goodwin | 292/144 |
| 4,276,760 | A * | 7/1981 | Nolin | 70/107 |
| 4,438,962 | A * | 3/1984 | Soloviff et al. | 292/144 |
| 4,579,376 | A | 4/1986 | Charlton | |
| 4,902,053 | A | 2/1990 | Hakkarainen et al. | |
| 5,044,184 | A * | 9/1991 | Herbers et al. | 70/277 |
| 5,083,448 | A * | 1/1992 | Karkkainen et al. | 70/277 |
| 5,199,288 | A * | 4/1993 | Merilainen et al. | 70/279.1 |
| 5,474,348 | A * | 12/1995 | Palmer et al. | 292/359 |
| 6,293,131 | B1 * | 9/2001 | Lemettinen et al. | 70/278.7 |
| 6,299,222 | B1 * | 10/2001 | Atmodimedjo | 292/144 |
| 6,302,456 | B1 * | 10/2001 | Errani | 292/332 |
| 6,418,765 | B1 * | 7/2002 | Chiu | 70/279.1 |
| 6,622,535 | B2 * | 9/2003 | Chiang et al. | 70/107 |
| 6,793,253 | B2 * | 9/2004 | Bruwer et al. | 292/144 |
| 6,851,287 | B1 * | 2/2005 | Yang et al. | 70/107 |
| 6,964,183 | B2 * | 11/2005 | Keightley | 70/279.1 |
| 7,946,080 | B2 * | 5/2011 | Ellerton et al. | 49/395 |
| 2002/0074806 | A1 * | 6/2002 | Perkins et al. | 292/14 |
| 2004/0261475 | A1 * | 12/2004 | Artsiely | 70/107 |
| 2006/0144102 | A1 * | 7/2006 | Keightley | 70/279.1 |

* cited by examiner

*Primary Examiner* — Christopher Boswell
*Assistant Examiner* — Eric Kurilla
(74) *Attorney, Agent, or Firm* — Woods Oviatt Gilman LLP

(57) ABSTRACT

In combination, a door, two latches at an edge of the door, and door latch operating components at opposite sides of the door; displaceable structure in the door having a position blocking movement of the latches, first mechanism responsive to displacement of one of the components for displacing the structure from blocking position to allow movement of the latches, for door opening; and electrically operable actuating means for effecting displacement of the structure from blocking position to allow movement of the latches, for door opening.

27 Claims, 8 Drawing Sheets

4
EXTERIOR
~22~
INTERIOR
~23~
25
24
15
16
18
17
80
81
14
15
10
140
12
11
13
4

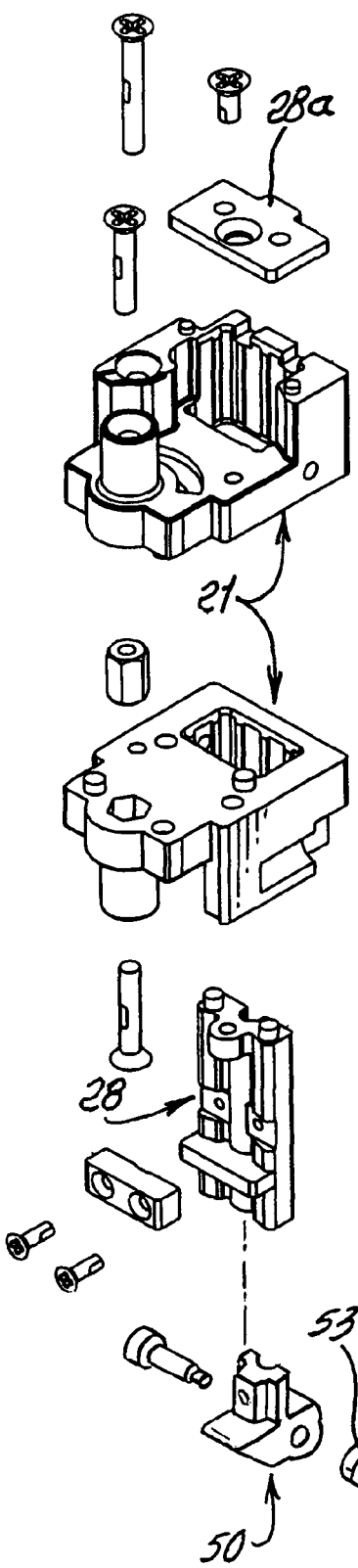
FIG. 8
FIG. 7
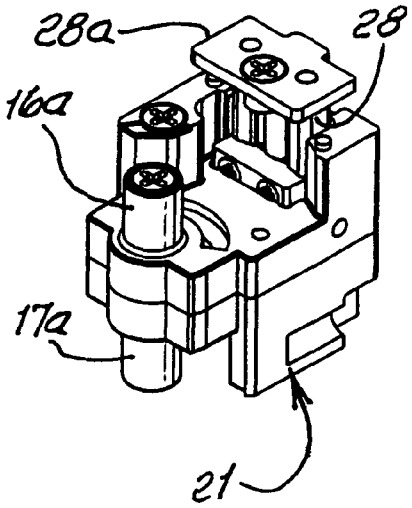
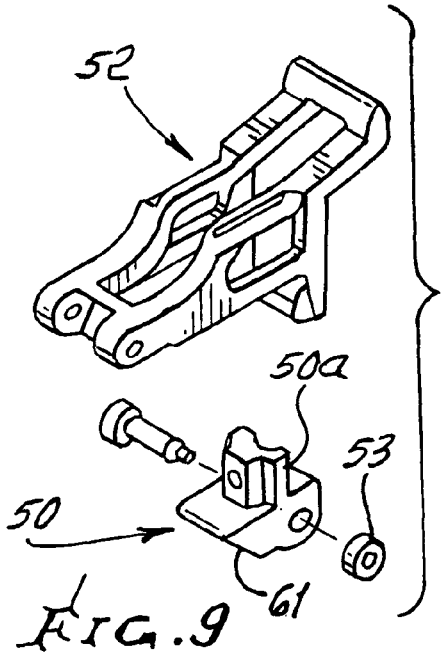
FIG. 9

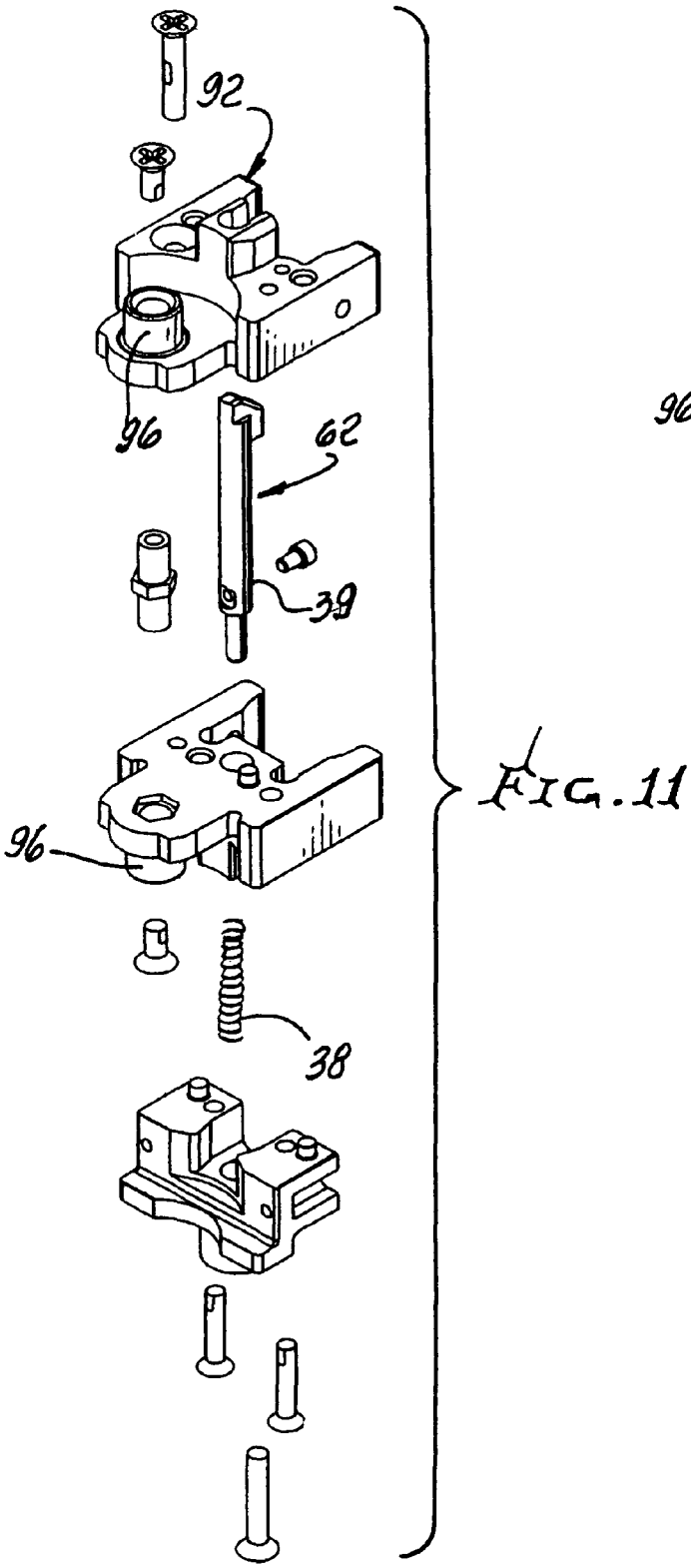
FIG. 11
FIG. 10
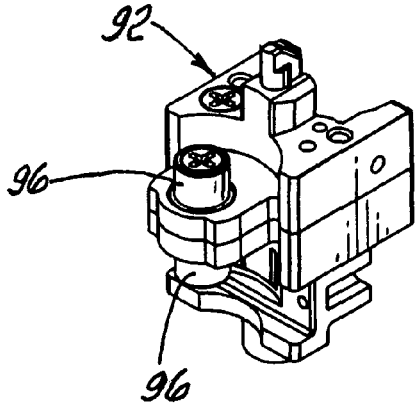

MULTIPLE ACCESS DOOR LOCK MECHANISM

BACKGROUND OF THE INVENTION

This invention relates generally to ease and reliability of highly responsive door unlocking mechanisms and more particularly to reliability of access to door unlocking, from both outside and inside locations, and with use of door handles as well as electronically responsive means.

There is continued need for the above referred to mechanisms, integrated in easily hand operated as well as electrically operated apparatus, installed in a door. There is also need for the simple, reliable, compact combination of elements, functioning as described and producing the improved results as will appear.

SUMMARY OF THE INVENTION

It is a major object of the invention to provide, in combination:

a) a door, two latches at an edge of the door, and door latch operating components at opposite sides of the door, b) displaceable structure in the door having a position blocking movement of the latches, c) first means responsive to displacement of either of the components for displacing the structure from blocking position to allow movement of the latches, for door opening, and d) electrically operable actuating means for effecting displacement of the structure from blocking position to allow movement of the latches, for door opening.

As will be seen, the structure typically includes a slider displaceable in response to operation of said first means, and also displaceable in response to operation of the actuating means.

A further object includes provision of a slider, movable in response to turning of either of said handles to displace the slider, allowing pivoting movement of the latches. In this regard, the actuating means may typically include a solenoid in the door and having a plunger movable to effect such structure displacement.

A frame that fits in the door typically carries the solenoid, actuating means, and slider all integrated in a highly compact combination and arrangement, to be responsive to manual operation of either of two components, as well as to electrical operation of the solenoid, thereby to facilitate unlocking of the door.

Another object is to provide two latches which are pivotally mounted in side-by-side relation, and which have latch pivoting actuating surfaces facing in opposite directions, to allow door opening in opposite directions. The latches are preferably pivotally mounted, and have their latch pivoting actuating surfaces facing in opposite directions.

Another object includes provision of actuating means that comprises a pull lever operatively connected to the slider and to a solenoid plunger, and having a first position in which retraction of the slider is blocked, and a second position in which the slider is unblocked and retracted, allowing movement of the latches. The operative connection to the slider may include a first part rigidly connected to the solenoid plunger and a second part slidably connected to said first part, and slidably connected to said lever, thereby accommodating to bodily movement of the latches and slider and a housing therefore. Also pivoting of the pull lever allows slider displacement in response to door handle turning, while remaining coupled to the inactive solenoid plunger.

Further, the actuating means typically may comprise a bodily movable dead latch pull and associated roller, the slide operatively connected to a handle, and characterized in that when the handle is turned, the slide is bodily moved to bodily move the dead latch pull which in turn pivotally displaces the lever to said second position, unblocking the two latches.

A further object includes provision of auxiliary latch means carried by the door, such that the pull lever projects between the said two latches and the auxiliary latch means. In this regard, the slider may have a first position in which it blocks pivoting of the latches, and a second position in which it is bodily displaced in two directions.

Yet another object includes provision of a housing for the two latches, and carried to be displaced laterally in a primary direction with the slider in unblocked condition, there being means to displace the slider endwise toward blocking position when the housing is returned laterally reversely relative to said primary direction. The means to so displace the slider advantageously includes cam surfaces that engage when the housing is returned laterally reversely. Such engagement may be effected by a spring located to continuously urge the housing in said reverse direction.

An added object is to orient the slider such that a spring is operable to transmit slider actuating force tending to elevate the slider as the solenoid operates to transmit force acting in opposition to said spring transmitted slider elevating force.

A yet further object is to provide for efficient operation of a door latch blocking and unblocking slider by either manually operated mechanical elements, such as a handle or handles, or a key, or alternatively by an electrically operated mechanism, in such manner that jamming of the slider unblocking movement and of the mechanical and electrical elements and their movements, is avoided. This is accomplished by highly integrated coupling and decoupling structures, operating as at opposite ends of that slider and in an installable frame, carried by a door.

These and other objects and advantages of the invention, as well as the details of an illustrative embodiment, will be more fully understood from the following specification and drawings, in which:

DRAWING DESCRIPTION

Figure 4:
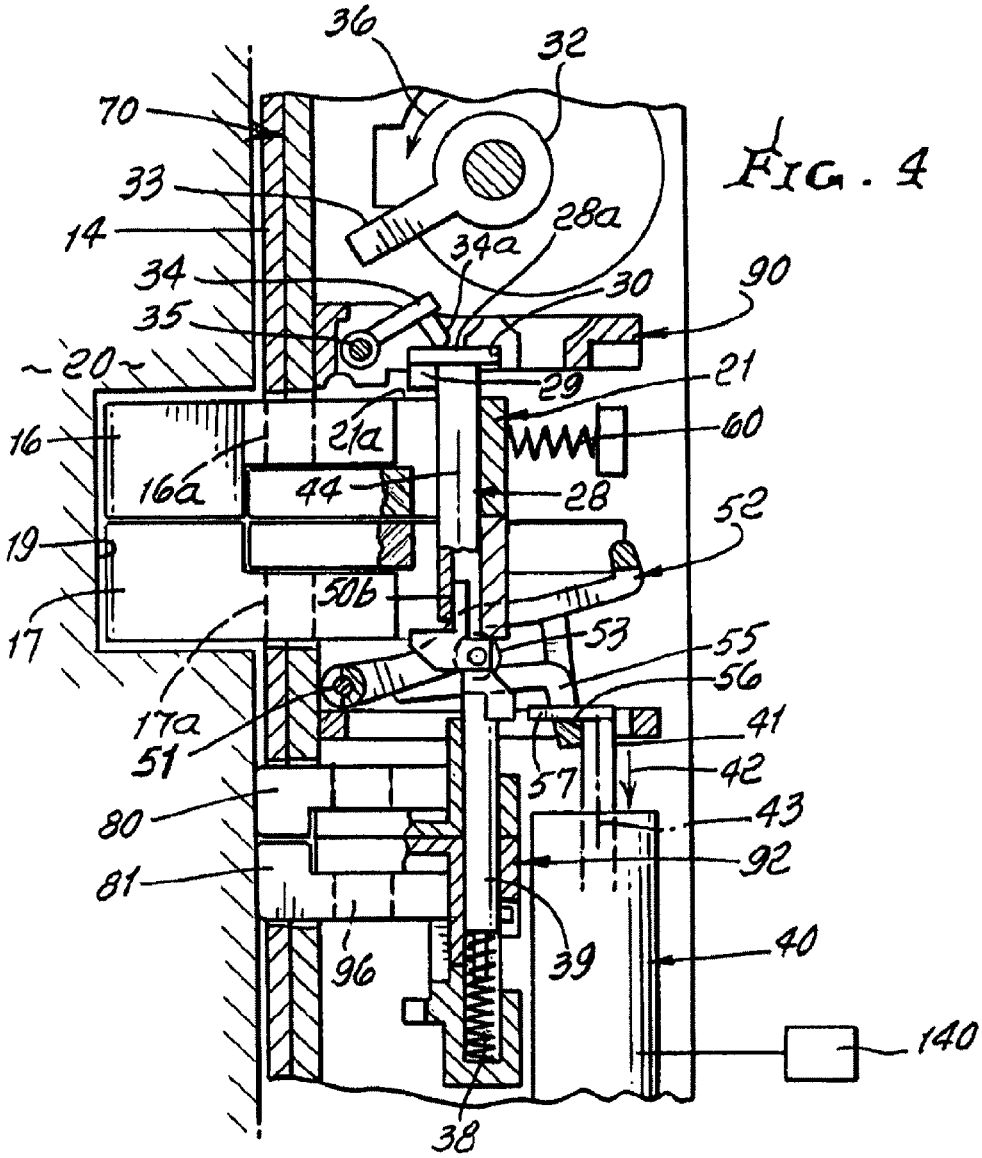
FIG. 4 is a section showing elements in detail, and their inter-relation.
Figure 4A:
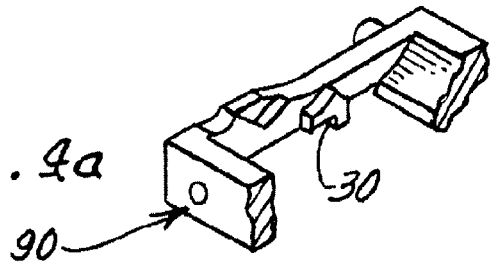
Figure 5:
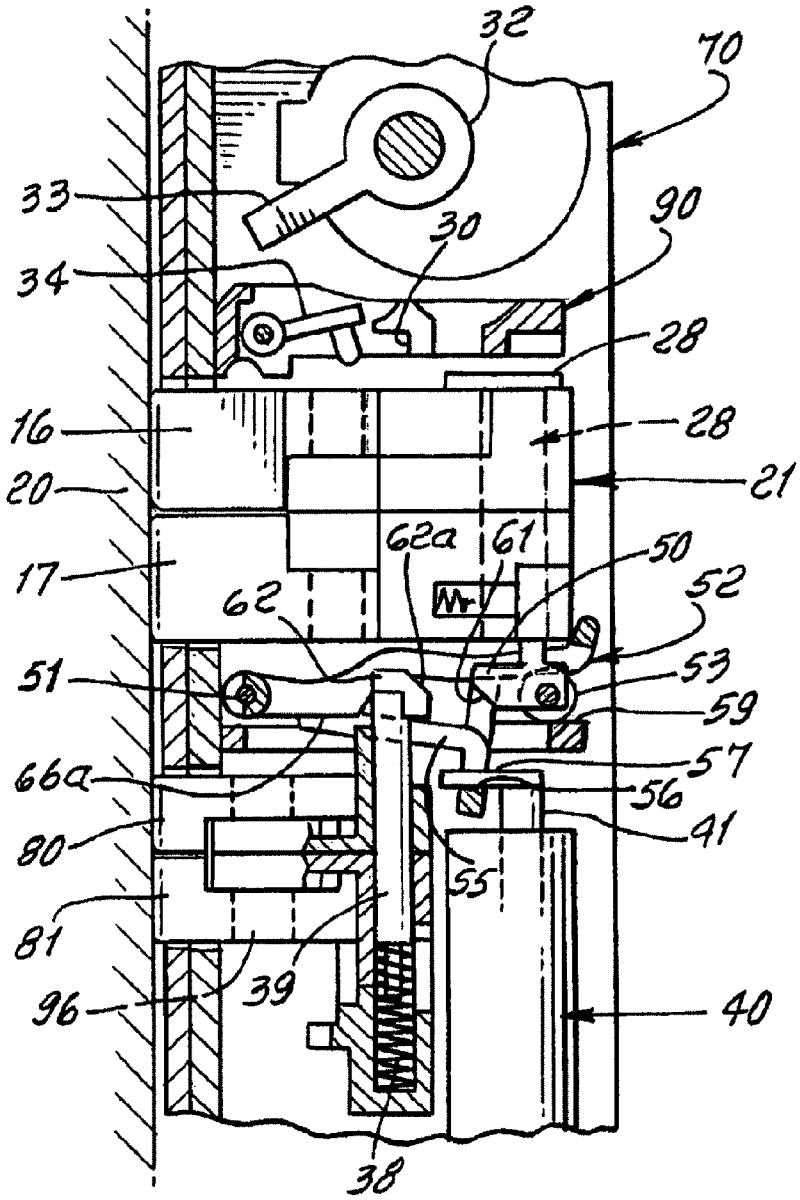
Figure 6:
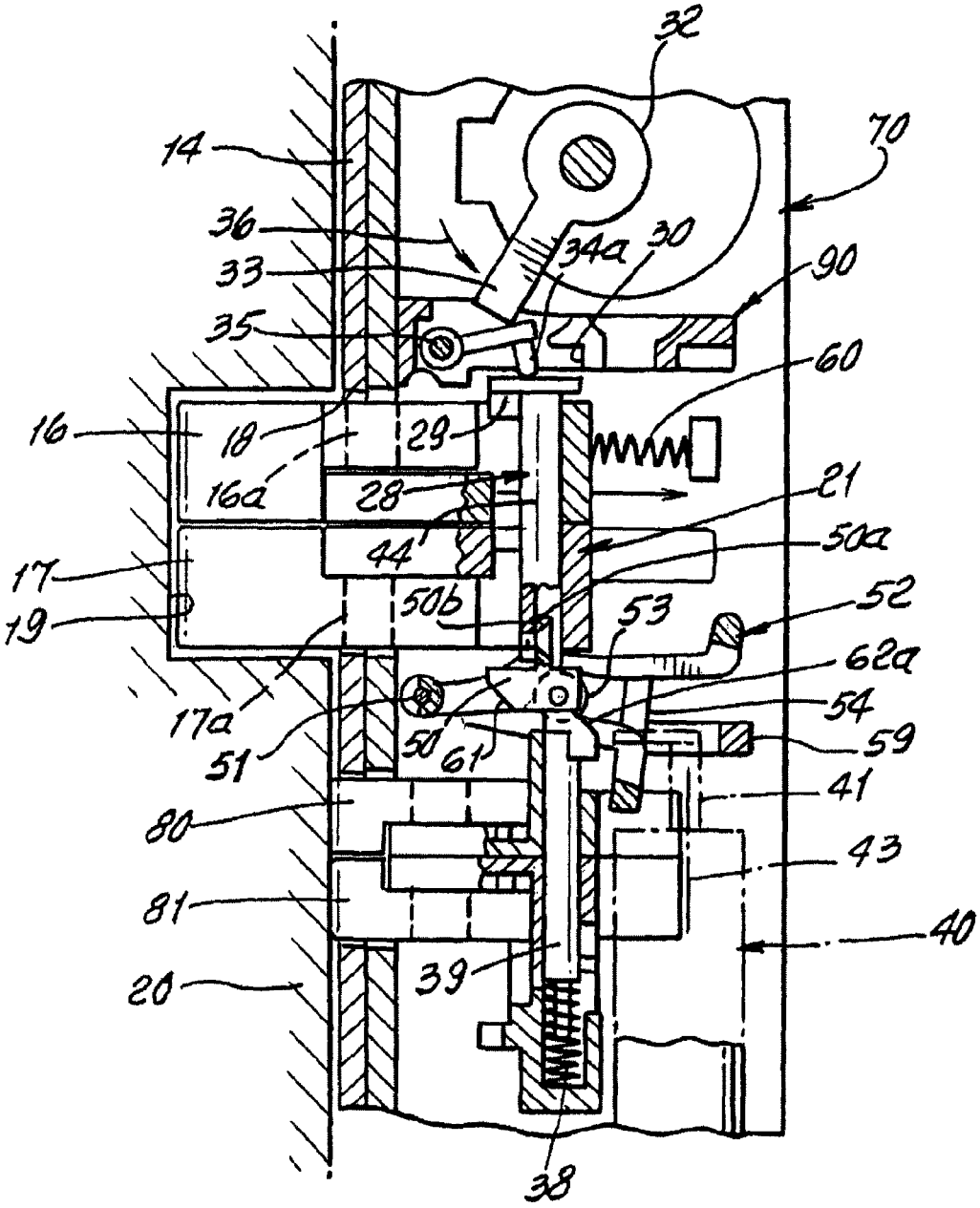

FIG. 4*a* is a perspective view of a device to stop slider rightward travel, in slider blocking position;

FIG. 5 is like FIG. 4, but shows elements in latch unblocking position;

FIG. 6 is like FIG. 5, but shows lever or key actuation of the slider;

FIG. 7 is a perspective view showing the slider and its housing;

FIG. 8 is an exploded endwise view of elements;

FIG. 9 is an exploded view of roller elements;

FIG. 10 is a perspective view of auxiliary bolt elements; and

FIG. 11 is another endwise exploded view of elements.

DETAILED DESCRIPTION

Figure 1:
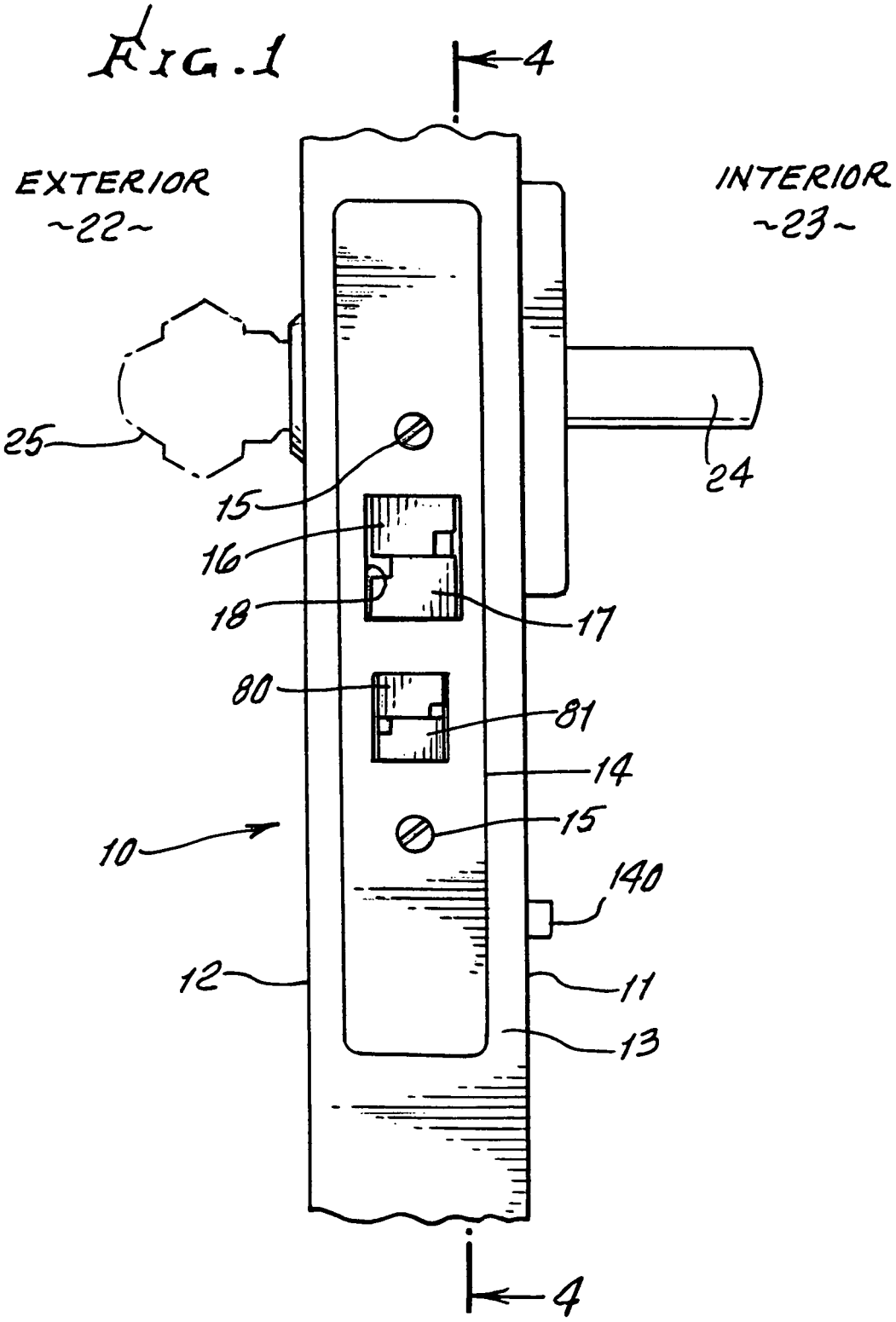
FIG. 1 is an edge view of a door, incorporating the invention.
Figure 2:
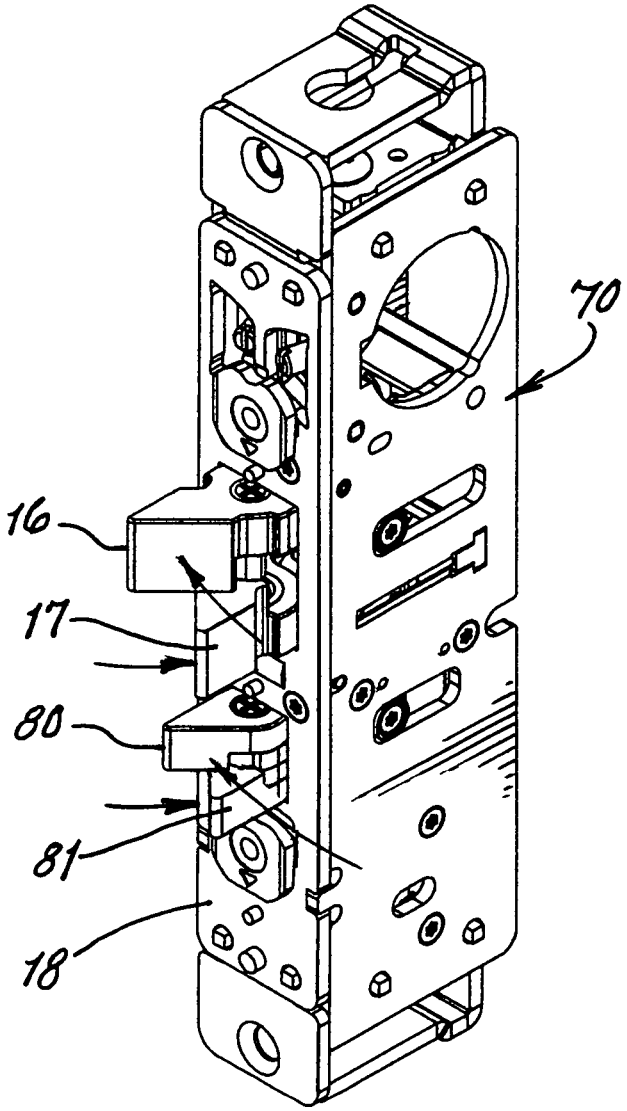
FIG. 2 is a perspective view of an assembly of elements, incorporating the invention.

Referring first to the preferred form of the invention in FIGS. 1-5, door 10 has an interior facing side 11, an exterior facing side 12, and an upright edge 13. A trim plate 14 is attached at 15 to that edge. A latch assembly includes a housing 21 and at least one latch 16, 17. Latches 16 and 17 protrude through an opening 18 in the plate 14, for retention in an opening 19 formed by wall 20. See FIG. 4. The latches are carried by housing 21, movable rightwardly from extended position as seen in FIG. 4 to a retracted position as seen in FIG. 5. In such FIG. 4 extended position, the latches retain the door in closed and locked position, and when the housing is in FIG. 5 retracted position, the door is unlocked, to move or swing to the exterior 22, and/or to the interior 23. Door latch operating components are indicated in FIG. 1, at 24 and 25, at opposite sides of the door. Component 24 is shown as a rotatable handle, and component 25 is shown as a rotatable key, but may be another handle.

Displacement structure is located in the door, to have a position or positions blocking movement of the latches, as in a retracting direction, i.e. rightwardly toward FIG. 5 position. Such structure may typically include a slider 28 carried by housing 21, to have a blocking position as shown in FIG. 4, and an unblocking position as appears in FIG. 5. Slider 28 is typically carried to be movable vertically between said positions; and in the example, the slider has a head 28*a* projecting in a recess 29 to engage a stop shoulder 30, in its first (i.e. rightward movement blocking) position. When the slider is moved downwardly toward housing top shoulder 21*a*, head 28*a* is released from blocking position in recess 29, to be movable rightwardly with the housing as the housing and latches are displaced to the right in response to latch pivoting, as the latch or latches pivotally engage the fixed wall 20. This enables door opening. Latch pivots are indicated at 16*a* and 17*a*.

In further accordance with the invention, and operation of the preferred mechanism, first means is provided to be responsive to displacement of one of the latch operating components 24 and 25, for displacing the displaceable structure (housing 21 and/or slider 28) from blocking position, to allow pivoting movement of the latches for door opening. In unpivoted positions, the latches hold the door locked, i.e. prevented from opening. Such first means is typically mechanically actuated and may advantageously include a rotor 32 having a dog or dogging arm 33, and a release lever 34 pivoted at 35. Lever 34 has a projection 34*a* that presses down on slider head 28*a* as the rotor is turned in direction 36, thereby displacing the slider 28 downwardly to unblock bodily movement of the slider and housing 21 to the right. Such downward force is sufficient to downwardly compress a compression spring 38, and a pusher 39 acting to urge the slider upwardly in FIGS. 4 and 6.

In addition, electrically operated actuating means is provided for effecting displacement of the displaceable structures from blocking position to allow pivoting movement of the latches, for door opening. Such electrically operated actuating means may advantageously include a solenoid 40 in the door 10 and in frame 70, and actuated by push button and associated circuitry 140. The solenoid has a plunger 41 movable downwardly in response to solenoid energization, in direction 42 to effect blocking structure displacement, including downward travel of the slider 28 toward unblocking position. Note that the axis 43 of plunger travel is out of alignment with the axis 44 of slider travel, but that axes 43 and 44 are generally parallel, for compactness. In this regard, the integration of components is such that spring 38 transmits slider actuating force tending to elevate the slider toward blocking position, the energized solenoid operating to transmit force acting in opposition to such spring transmitted elevating force, and acting to lower the slider. When the solenoid is actuated, the force of spring 38 is overcome.

Coupling and decoupling mechanism shown that aids in achieving the above movements further includes a slider pull part 50 having an upward projection 50*a* engaging the slider at 50*b*; a pull lever 52 pivot at 51 and extending generally laterally, proximate to and above a roller 53 carried on part 50; and a slide connection at 56 between an actuator 55 and a tab 57 connected to the plunger 41.

As plunger 41 is pulled down by the solenoid, the pull lever 52 is swung clockwise downwardly, to pull part 50 downwardly, pulling the slider down to unblocked position. This allows the housing 21 for the latches to be displaced to the right, as referred to above, displacing the slider and part 50 to the right, to FIG. 5 position, unlocking the door. During such displacement, roller 53 engages fixed structure horizontal surface 59, guiding rightward travel of part 50.

When the solenoid is de-energized, i.e. decoupled from the slider, leftward return travel of the housing, slider 28 and part 50 is urged by a return spring 60. An angled cam surface 61 traveling on part 50 then engages a cam surface 62*a* on an actuator 62 carried by pusher 39 (see FIG. 5), such engagement acting to displace the lever 52 counterclockwise, allowing the spring urged pusher 39 to displace the slider 28 back upwardly into blocking position, as seen in FIG. 4. Thus, when the solenoid is decoupled, the slider locks up, in FIG. 4 position. These movements also act to elevate the solenoid plunger, the L-shaped guide element 55 projecting under the lever 52 at 66*a* after assisting in this restorative functioning.

In regard to such components and movements, a frame 70 is provided to carry the components, as shown. Auxiliary bolts are pivotally carried by the frame, below pivot 53.

Figure 3:
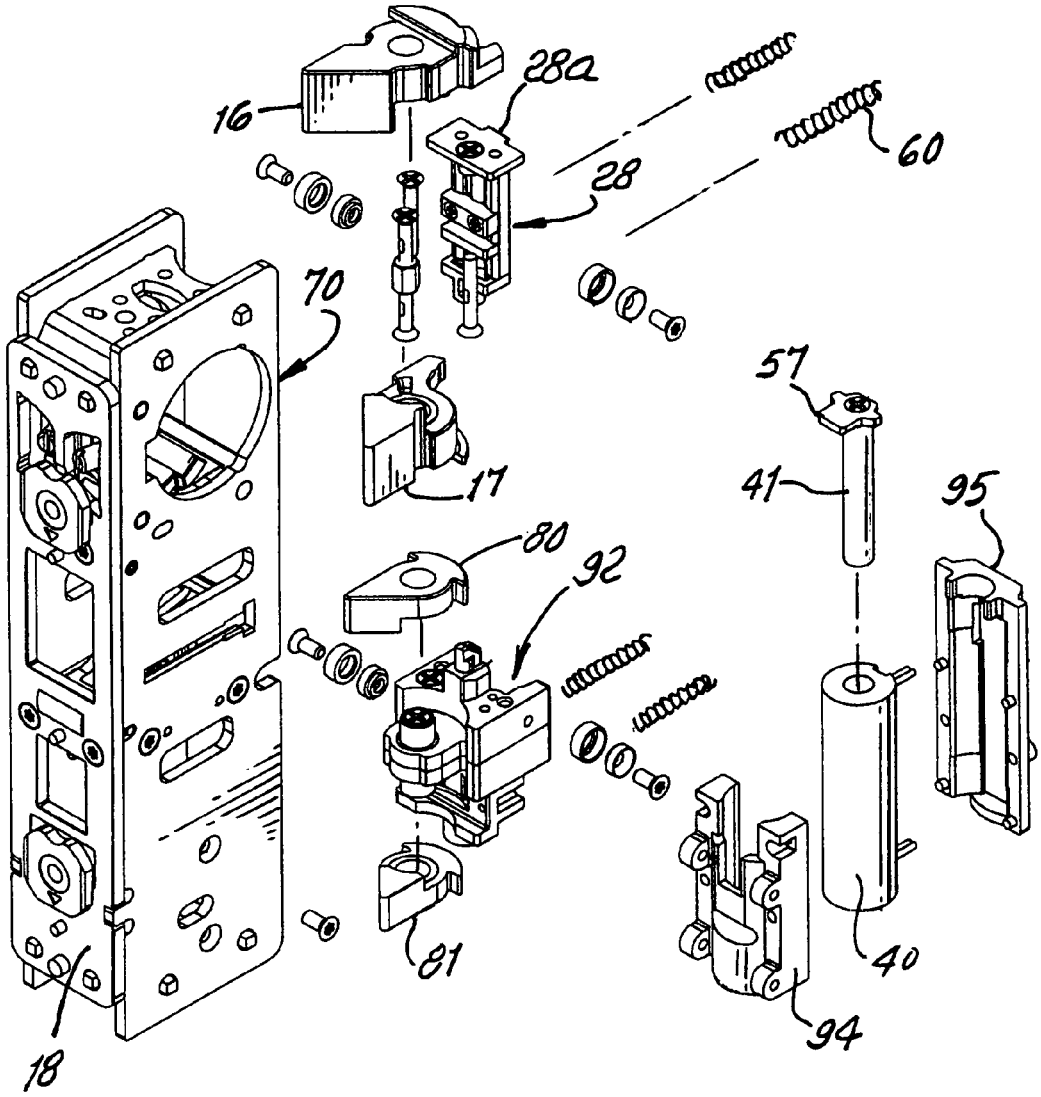
FIG. 3 is an exploded view of elements employed.

A dead latch guide 90 is shown in FIGS. 4 and 4*a*, to define slider head stop 30. A solenoid support cradle 94 is shown in FIG. 3, as is a solenoid cover 95.

Also provided are auxiliary bolts 80 and 81 carried by the frame, via bolt body 92, below the housing 21. FIG. 10 shows mounting post 96 for the auxiliary bolt(s).

What is claimed is:

1. A door latch system configured for being disposed within a door for selectively locking the door relative to a door frame, the system comprising:

a latch assembly including a housing and at least one latch movable between a locked position and an unlocked position;

a slider directly engagable with the latch assembly and configured for moving between a blocking position and an unblocking position, the blocking position preventing movement of the latch assembly from the locked position to the unlocked position, and the unblocking position allowing movement of the latch assembly between the locked position and the unlocked position;

a first actuator configured to operatively engage the slider; and a second actuator configured to operatively engage the slider, wherein the first actuator and the second actuator are independently operable to displace the slider from the blocking position to the unblocking position thereby allowing the latch assembly to move from the locked position to the unlocked position.

2. The door latch system of claim 1, wherein the slider includes a longitudinal axis, and wherein the slider is configured for moving between the blocking position and the unblocking position along the longitudinal axis.

3. The door latch system of claim 2, wherein the longitudinal axis of the slider is a first longitudinal axis, wherein the second actuator includes a solenoid and a plunger, wherein the solenoid is operatively engaged with the plunger, wherein the plunger has a second longitudinal axis, wherein the plunger is movable by the solenoid along the second longitudinal axis to effect displacement of the slider from the blocking position to the unblocking position, and wherein the first longitudinal axis is parallel with the second longitudinal axis.

4. The door latch system of claim 1, wherein the second actuator is operatively decoupled from the slider when the first actuator is operatively engaged with the slider, and wherein the first actuator is operatively decoupled from the slider when the second actuator is operatively engaged with the slider.

5. The door latch system of claim 1, wherein the second actuator includes a solenoid and a plunger, wherein the solenoid is operatively engaged with the plunger, and wherein the plunger is movable by the solenoid to effect displacement of the slider from the blocking position to the unblocking position.

6. The door latch system of claim 1, further comprising a slider biasing member configured for biasing the slider toward the blocking position.

7. The door latch system of claim 6, further comprising a pusher coupled with the slider biasing member.

8. The door latch system of claim 1, wherein the slider is slidably disposed within the housing.

9. The door latch system of claim 8, further comprising a housing biasing member configured for biasing the latch assembly toward the locked position.

10. The door latch system of claim 1, wherein the at least one latch is two latches, wherein the two latches are pivotally mounted in side-by-side relation and have latch pivoting actuating surfaces facing in opposite directions.

11. The door latch system of claim 1, wherein the first actuator includes:

a handle configured for being rotatably mounted to the door;

a rotor coupled with the handle, the rotor having a dog extending therefrom; and a release lever configured for being pivotally mounted to the door, wherein the dog is configured for selectively engaging the release lever when the handle is rotated to move the slider to the unblocking position.

12. The door latch system of claim 1, wherein said slider is movably disposed in said housing, and wherein said housing is movable with said at least one latch when said at least one latch moves between said locked and unlocked positions.

13. A door latch system configured for being disposed within a door for selectively locking the door relative to a door frame, the system comprising:

a latch assembly including a housing and at least one latch movable between a locked position and an unlocked position;

a slider directly engagable with the latch assembly and configured for moving between a blocking position and an unblocking position, the blocking position preventing movement of the latch assembly from the locked position to the unlocked position, and the unblocking position allowing movement of the latch assembly between the locked position and the unlocked position;

a pull lever configured for being pivotally coupled with the door and movable between a first position and a second position, the pull lever operatively connected to the slider, wherein the pull lever is disposed in the first position when the slider is in the blocking position, and wherein the pull lever is disposed in the second position when the slider is in the unblocking position;

a first actuator configured to operatively engage the slider to move the slider to the unblocking position; and a second actuator configured to operatively engage the pull lever when in the first position to move the slider to the unblocking position, wherein the first actuator and the second actuator are independently operable to displace the slider from the blocking position to the unblocking position thereby allowing the latch assembly to move from the locked position to the unlocked position.

14. The door latch system of claim 13, wherein the pull lever includes a lever actuator, wherein the lever actuator is configured to engage the second actuator when the pull lever is in the first position.

15. The door latch system of claim 13, further comprising a roller mounted on the slider, wherein the roller slidably engages the pull lever to allow the latch assembly to move to the unlocked position.

16. The door latch system of claim 13, wherein the slider is slidably disposed within the housing.

17. The door latch system of claim 16, further comprising a housing biasing member configured for biasing the latch assembly toward the locked position.

18. The door latch system of claim 13, further comprising a slider biasing member configured for biasing the slider toward the blocking position.

19. The door latch system of claim 18, further comprising a pusher coupled with the slider biasing member.

20. The door latch system of claim 19, wherein the slider includes a first cam surface, wherein the pusher includes a second cam surface, wherein the first and second cam surfaces are configured to engage one another when the latch assembly is moved from the unlocked position toward the locked position.

21. The door latch system of claim 13, wherein the second actuator is operatively decoupled from the slider when the first actuator is operatively engaged with the slider, and wherein the first actuator is operatively decoupled from the slider when the second actuator is operatively engaged with the slider.

22. The door latch system of claim 13, wherein the second actuator includes a solenoid and a plunger, wherein the solenoid is operatively engaged with the plunger, and wherein the plunger is movable by the solenoid to effect displacement of the pull lever to the second position to displace the slider from the blocking position to the unblocking position.

23. The door latch system of claim 13, wherein the slider includes a first longitudinal axis, and wherein the slider is configured for moving between the blocking position and the unblocking position along the first longitudinal axis.

24. The door latch system of claim 23, wherein the second actuator includes a solenoid and a plunger, wherein the solenoid is operatively engaged with the plunger, wherein the plunger has a second longitudinal axis, wherein the plunger is movable by the solenoid along the second longitudinal axis to effect displacement of the slider from the blocking position to the unblocking position, and wherein the first longitudinal axis is parallel with the second longitudinal axis.

25. The door latch system of claim 13, wherein the at least one latch is two latches, wherein the two latches are pivotally mounted in side-by-side relation and have latch pivoting actuating surfaces facing in opposite directions.

26. The door latch system of claim 13, wherein the first actuator includes:

a handle configured for being rotatably mounted to the door;

a rotor coupled with the handle, the rotor having a dog extending therefrom; and a release lever configured for being pivotally mounted to the door, wherein the dog is configured for selectively engaging the release lever when the handle is rotated to move the slider to the unblocking position.

27. The door latch system of claim 13, wherein said slider is movably disposed in said housing, and wherein said housing is movable with said at least one latch when said at least one latch moves between said locked and unlocked positions.

* * * * *